US006009733A

United States Patent [19]

Cheers et al.

[11] Patent Number: 6,009,733

[45] Date of Patent: Jan. 4, 2000

[54] METHOD OF ORIENTING CANS

[75] Inventors: Christopher Francis Cheers, Wiltshire; Richard John Hensley, Gloucestershire; Christopher Paul Ramsey, Oxfordshire, all of United Kingdom

[73] Assignee: Crown Cork & Seal Technologies Corporation, Alsip, Ill.

[21] Appl. No.: 09/068,607

[22] PCT Filed: Nov. 27, 1996

[86] PCT No.: PCT/GB96/02915

§ 371 Date: May 11, 1998

§ 102(e) Date: May 11, 1998

[87] PCT Pub. No.: WO97/21505

PCT Pub. Date: Jun. 19, 1997

[30] Foreign Application Priority Data

Dec. 12, 1995 [GB] United Kingdom ..... 9525391

[51] Int. Cl.[7] ..... B21D 51/26

[52] U.S. Cl. ..... 72/17.3; 72/94; 72/421

[58] Field of Search ..... 72/11.1, 15.2, 72/15.3, 17.3, 94, 105, 420, 421

[56] References Cited

U.S. PATENT DOCUMENTS 5,035,569 7/1991 Alznauer .

5,058,724 10/1991 Hinton .

FOREIGN PATENT DOCUMENTS

| | | |
|---|---|---|
| 398051 | 4/1990 | European Pat. Off. . |
| 3135738 | 9/1981 | Germany . |
| 746676 | 11/1953 | United Kingdom . |
| 2077684 | 6/1981 | United Kingdom . |
| 2251197 | 11/1991 | United Kingdom . |

*Primary Examiner*—Lowell A. Larson
*Attorney, Agent, or Firm*—Diller, Ramik & Wight, PC

[57] ABSTRACT

A method of orienting cans on a continuously rotating machine, in which the machine has a plurality of rotating heads for can bodies (2), each of the heads having a sensor (9) for detecting the orientation of the can body. Each head comprises a mandrel (6), chuck (8) and can carrier (7). In one embodiment, the chuck and mandrel rotate at different speeds. The can body is generally held by the chuck but is transferred to the mandrel in order to impose the required orientation on the can body. In an alternative embodiment, each chuck is driven by an independent motor (15) and orientation is achieved by imposing a motion profile on the chuck to correct any error. An unique mark or series of marks is provided at or around a free edge of the can body so that the sensor can detect the orientation of the can body. Typically these marks are hidden in the finished product by a double seam which joins the can end to the can body.

11 Claims, 5 Drawing Sheets

METHOD OF ORIENTING CANS

BACKGROUND OF THE INVENTION

This invention relates to orientation of cans and, in particular, to the orientation of cans which are to have a textured finish which should preferably be registered with the can print, side seam or other features. Such cans may include food cans, beverage cans or aerosol cans, and may be drawn and wall-ironed (DWI), drawn and redrawn (DRD) or may have welded bodies.

One example of texturing is known as "roll-forming", in which cans are placed on a profiled mandrel and are rolled between the mandrel and a curved rail. A single revolution of the can is required to form the desired textured finish. This texturing method is described in particular in GB-A-2251197, where the mandrel is profiled with flutes so that the can body is deformed into the fluted configuration of the mandrel during the roll-forming operation. Alternatively, texturing may be achieved by forming the can between a hard profiled rail and a mandrel of elastomeric material. The textured or fluted finishes which can be obtained by such roll-forming is aesthetically pleasing but would be further enhanced if such texturing could be formed in register with print or other surface features on the can body.

GB-A-2077684 describes an apparatus for aligning bottles which have a mark in the form of a black line on the bottle neck. The apparatus uses a starwheel with spaces for the bottles, each space having a belt which engages and rotates the bottle and prevents the bottle from rotating further when the black line is detected. Such a system is not viable for registration at line speeds of the order of 1000 containers per minute and cannot align the containers with an accuracy of up to 0.5 mm+0.25 mm which is desired by present day can manufacturing lines. Furthermore, the black mark used in GB-A-2077684 would still be visible in the final product.

SUMMARY OF THE INVENTION

According to the present invention, there is provided a method of orienting cans comprising: providing at least one unique mark at or around a free edge of each can body; scanning at least a section of the unique mark with a sensor; and correcting the orientation of each can body in accordance with positional data obtained by the scanning step; in which the unique mark is provided in such a position that, in use, when the can body is closed by a can end fixed to the can body around the free edge, the unique mark is covered.

In the present invention, when the can end is joined to the can body by a double seam, for example, the mark is therefore invisible. Since the mark is hidden, it will not detract from the appearance of decorated flutes, texturing, or other roll-formed feature. In addition, the use of a unique mark enables registration to be achieved independently of changes in the design or pattern of the can.

The unique mark may comprise a series of sets of markings which extend around the whole of the periphery of the free edge so that at any position of the can, at least one set of marks can be scanned to determine the orientation of the can.

Each set of markings, or code sector, may comprise a start sector mark followed by a binary code and, in a three piece can, preferably includes a weld sector. The start sector mark defines the start of the sector and the binary code represents the position on the can body e.g. relative to a welded seam in a three-piece can. Alternative marking methods may be used, if preferred, such as lettering or pictorial data but these may be less satisfactory due to high speed of the machine and the time required to process such a form of data. Furthermore, the type of sensor required to read data of this type may be more complex and expensive.

The method may be used for either two or three piece cans. The unique mark may be provided in an independent operation or, more preferably, it may be printed together with the actual decoration of the container for a two piece container or in a sheet from which a three piece container is to be formed.

According to a further aspect of the present invention, there is provided a decorated roll-formed container, comprising a roll-formed body and an end fixed to the body by a double seam, in which the body includes at least one unique mark beneath the double seam whereby the decoration is registered to the roll-formed features.

According to another aspect of the present invention, there is provided a method of orienting cans on a continuously rotating machine, the method comprising:

- providing a unique mark on each of a plurality of can bodies;
- feeding the can bodies to the continuously rotating machine;
- engaging each can body on a respective chuck;
- rotating the can body at a first speed;
- moving the can body axially over a mandrel rotating at a second speed;
- providing a sensor for each can body position on the turret;
- sensing the position of each can body by detecting its unique mark;
- repeatedly verifying the position of each can body by detecting a series of non-unique marks;
- evaluating the required position of each can body;
- comparing the sensed position of each can body with the required position; and
- correcting the orientation of each can body.

Continuous measurement of can orientation is possible with the method of the present invention since individual sensors are provided for each can position. There is thus no need for sophisticated data analysis or for the unique mark to be in the form of binary code markings as would be necessary if, for example, a single camera were used instead of several sensors. A unique mark or regular mark spacing with a unique mark and simple counting of marks over a maximum of one revolution is all that is required. Even the use of a plurality of sensors in the present invention is a fraction of the cost of a single CCD camera which would also require a separate light source of consistent quality.

According to this aspect of the present invention, the unique mark may be a single mark on the can body, or it may be a different mark in a series of otherwise identical regularly spaced marks. The unique mark may be different by being a longer mark which may be obtained where printing of marks around the circumference of a can body overlaps. Alternatively the unique "mark" may be a gap in the regular marks, i.e. the absence of a mark. Typically, a series of light and dark marks are printed around the top edge of the can body, where these will ultimately be hidden by a seam when an end is seamed onto the can body. The unique mark specifies absolute angular position of the can body once per revolution, whilst the regular marks specify a position relative to the unique mark.

The sensor is preferably positioned to detect the unique mark both at the beginning of the forming process and, advantageously, also at the end of the forming process. The unique mark may be positioned such that it will be hidden by a seam when an end is seamed onto the can body or, alternatively, a single mark may readily form part of the decoration on the can body.

Once the can is in the correct orientation, registering with roll-formed features is possible. The method therefore preferably further comprises a forming or "texturing" step after orientation has been corrected. Furthermore, the method may provide data for quality control in addition to orientation, if registration of can features and texturing is monitored after forming.

The provision of chucks which engage each can body in addition to the plurality of mandrels enables orientation of the can body to be corrected in different manners. For example, in one embodiment, the first and second speeds are different and the correcting step comprises calculating a transfer time from the difference between these speeds and the required change in orientation; and transferring the can body from the chuck rotating at the first speed onto the mandrel rotating at the second, different speed, after the transfer time has elapsed, whereby the can body is correctly oriented.

The can body may be retained on the chuck by a partial vacuum. In the first embodiment, a vacuum is "supplied" to either the chuck or the mandrel. The transfer is thus achieved smoothly at maximum speed. Preferably, the can then remains on the mandrel until texturing starts and throughout the forming process. After texturing, the can body may be transferred back onto the chuck which assists in keeping the can body in the can carrier while it is moved off the mandrel ready for discharge.

In an alternative embodiment, the first and second speeds are initially the same and the correcting step comprises calculating and imposing variations in the speed of the chuck and/or mandrel to provide the required orientation. The chuck may be driven in this embodiment by a motor, the speed of the motor being varied in order to vary the chuck speed. A control system may be used to calculate a series of motor speed variations, known as a motion profile, which provide the necessary re-orientation before forming starts.

In a further embodiment, the first and second speeds are initially different and an accelerating motion profile is applied to the chuck and/or mandrel in order to provide the necessary re-orientation for the can. Generally, the chuck speed is increased until it is in line with the mandrel speed, as determined by the control system.

When the speed of the chuck is varied to provide orientation, it is necessary during forming to prevent the motor fighting the mandrel for position of the can, the mandrel and a curved rail being used to carry out the texturing process. This may be achieved by allowing the motor to "freewheel". Alternatively, a clutching or slipping clutch operation may be used.

In a beading or texturing operation, a stack of can bodies is introduced at one side of a frame. A turret is driven about the frame with a plurality of mandrels mounted around the turret for rotation on axles fixed to the turret. Each can body is loaded into a can carrier which moves the can body onto a mandrel. In the present invention, a chuck is also provided so that the can carrier moves both the chuck and the can body.

In order to texture the can body, the can body rolls on the mandrel over a forming rail, the can body thereby obtaining a profile which may be provided either on the mandrel as described in GB-A-2251197 or on the forming rail itself, or on both the mandrel and the forming rail.

In accordance with the present invention, a sensor and actuator may be fixed to the rotating turret adjacent to each of a plurality of heads, corresponding to each can carrier, chuck, can body and mandrel combination. Thus, as the machine turret rotates, the can body is at a fixed distance from the sensor and is rotating relative to it. Alternatively, a sensor may be fixed to each can carrier. Although the can carrier moves relative to the turret, the can body remains at a fixed distance from the sensor, rotating relative to the sensor, since movement of the can carrier is axial only.

Generally, the method comprises registering can body orientation as determined by the sensor until forming/texturing starts. Preferably, registering is continuous throughout the forming step but may be interrupted by the forming and restarted immediately after forming has been completed. The method may further comprise calculating and recording any error in the orientation after forming has taken place. This gives an indication of how accurately texture length matches decoration on the can body. If the error signal is outside a predetermined tolerance, the can body may be automatically rejected.

Further advantages in the calculating of any error between orientation before and after forming are that the measurements may be recorded for statistical analysis and the mean value of the orientation error at the start of forming may be used to improve the orientation of future can bodies passing through the machine. Alternatively, the error may be displayed or otherwise transmitted to an operator so as to indicate that the machine requires adjustment. Variability in the orientaton error may be used as a measure of process capability and used to trigger an alarm as an early warning of machine faults.

According to a further aspect of the present invention, there is provided an apparatus for roll-forming cans with registered decoration, the apparatus comprising:

a frame; a turret driven to rotate about an axle fixed to the frame; a plurality of mandrels mounted around the turret for rotation on axles fixed to the turret; a plurality of chucks for driving can bodies; means for rotating each chuck at a first speed; means for rotating each mandrel at a second speed; a plurality of sensors, one for each can body, for detecting orientation of the can body; and means for varying the speed of rotation of each can body whereby the orientation of the can body is corrected.

Different embodiments may include registering the decoration so as to have different colors on individual flutes, providing script around folded or textured areas, or simply orienting the decoration to the front of a welded can so that the decoration is always centrally positioned.

The roll-formed features may comprise fluting, texturing or folding for example, and decoration may be aesthetic or functional as desired. It will be appreciated that the invention is not limited in any way by the nature of the roll-formed features or by the decoration applied.

Preferred embodiments of the method will now be described, by way of example only, with reference to the drawings, in which:

DESCRIPTION OF THE PREFERRED EMBODIMENTS

Figure 1:
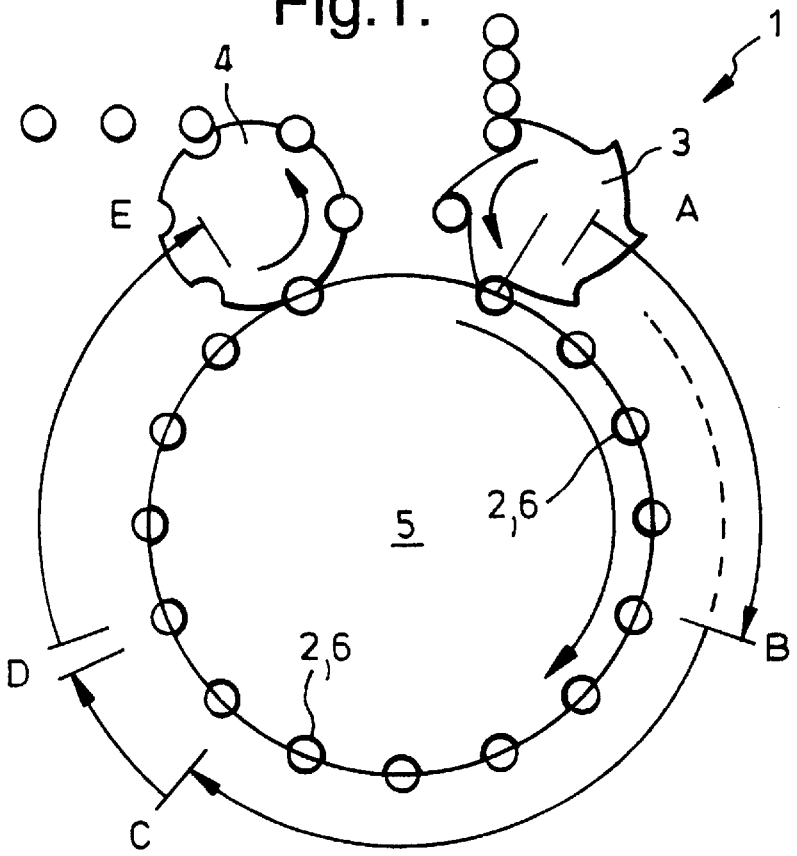
FIG. 1 is a partial front view of an apparatus for orienting a can body.

FIG. 1 shows an apparatus for roll-forming a series of can bodies 2 with textured features in the can side wall. The apparatus 1 comprises a starwheel 3, for separating the cans on entry and a discharge wheel 4, one on either side of a frame. A turret 5 is driven to rotate about the frame and sixteen mandrels 6 are mounted about the turret for rotation on axles fixed to the turret.

References A, B, C, D and E are used to indicate the various stages of orienting and texturing. The can bodies are fed into the machine at A via star wheel 3 and each can body is loaded in turn into a can carrier. A vacuum chuck then engages the can body and the can body and chuck are moved axially onto a mandrel between positions A and B.

In one embodiment, sensing of the can position and correction of orientation occurs between B and C. In a second embodiment, where the can does not need to be in position on the mandrel for orientation to occur, the sensing and orientation correction may take place from just after position A, when the chuck has engaged the can body.

Can forming occurs between positions C and D, one revolution being required in order to complete the forming operation. A hard textured rail is thus located between C and D and the can body is pinched between this hard rail and a soft mandrel, typically of elastomeric material, in order to achieve the desired textured finish. In an alternative embodiment, a soft smooth curved rail and a hard profiled mandrel may be used.

In the first embodiment, the can body is simply moved off the mandrel between positions D and E, whereas in the second embodiment, orientation may be checked during this rotation also.

Finally, the can bodies are discharged from the turret at position E.

Figure 2:
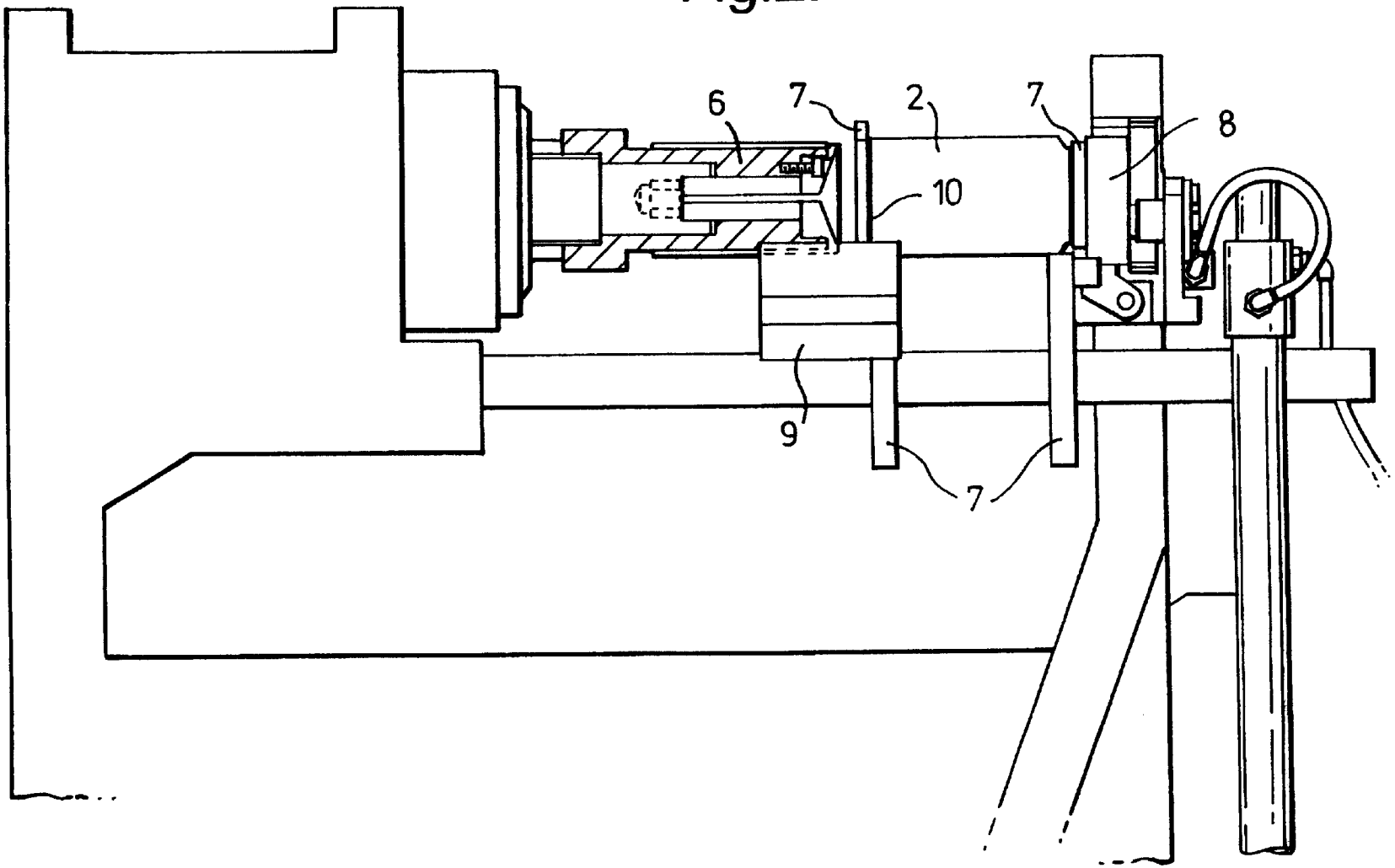
FIG. 2 is a side view of a can carrier and can prior to feeding onto a mandrel.

FIG. 2 is a side view of the can body 2 mounted in a can carrier 7 prior to moving the can onto mandrel 6. The can body is engaged at its base by a vacuum chuck 8. In this arrangement a sensor 9 is fixed to the can carrier for monitoring the position of the can. The sensor 9 is a photoelectric device which looks at a unique mark, for example in a code strip 10 around the top edge of the can.

The code is hidden in the finished article by a double seam, when a can end is seamed onto the can body. A possible design of hidden code is described below with reference to FIGS. 5 and 6. The code described below is, however, more complex than is essential when using individual sensors since only a single unique mark, or regularly spaced marks with a single longer mark or similar indicator is necessary when continuous sensing is used. At most the can body needs to rotate a full revolution before this unique mark is seen.

Figure 3:
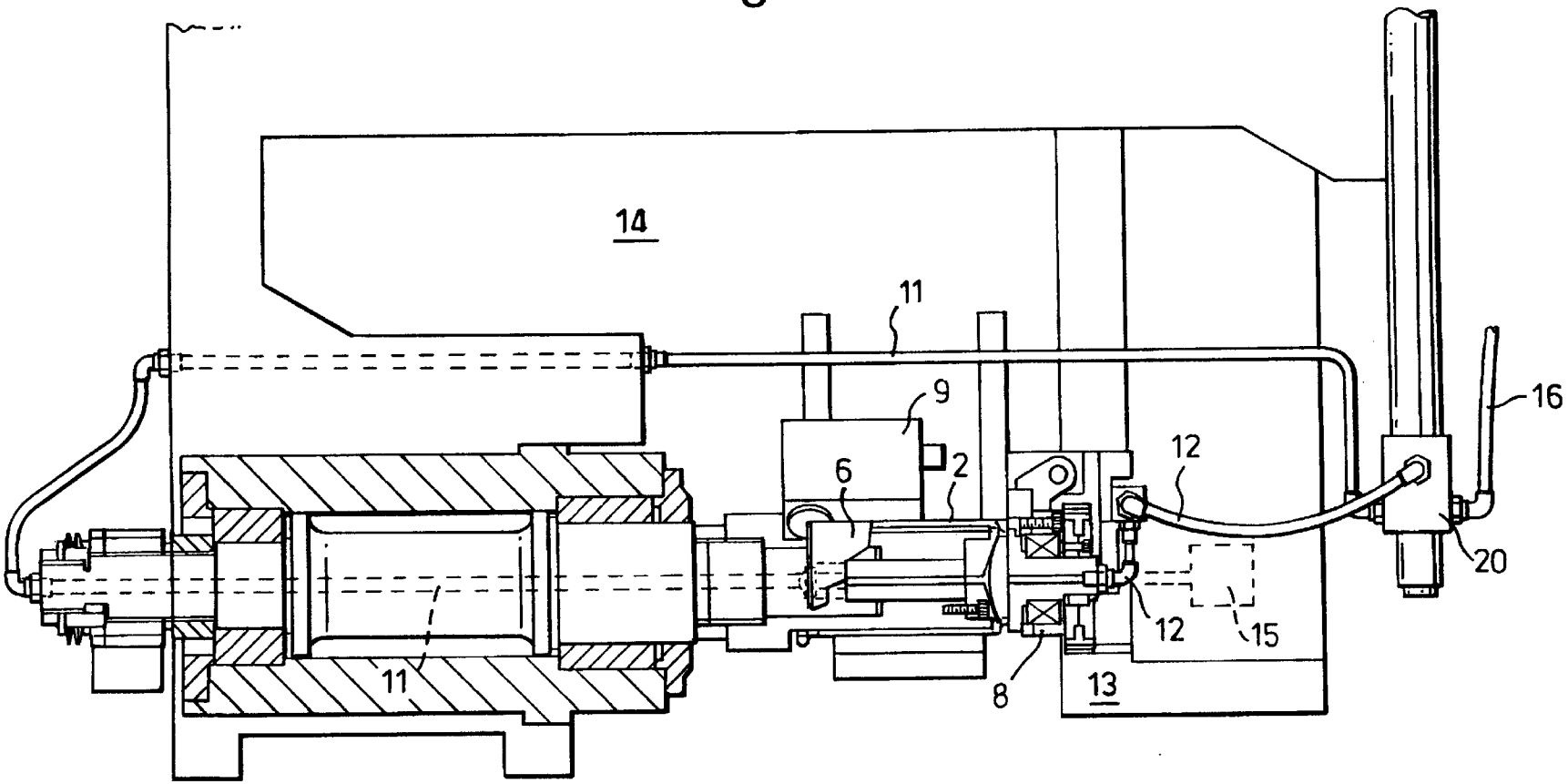
FIG. 3 is a side section of a can after feeding onto a mandrel.

FIG. 3 shows the can 2 in position over mandrel 6 and engaged by chuck 6. Compressed air or a vacuum is applied to the mandrel via line 11 and to chuck 8 via line 12. In the embodiment shown, the chuck is driven by a ring gear 13 via a pinion while the mandrel is driven by ring gear 21 via another pinion. The different diameters of the two pinions (that for the chuck being of larger diameter than that for the mandrel) means that the speeds of rotation of the mandrel and chuck are different although both constant, while the turret rotates at constant speed.

Orientation is achieved by transfer from the chuck to the mandrel at a particular point in the rotation cycle. This type of clutching system is inexpensive and extremely robust although it achieves its best accuracy at low speed. A control system is situated as shown generally at 14, one control system being typically used to control orientation of two cans. There are thus eight control systems required for control of sixteen can positions around the turret.

In an alternative embodiment, the chuck is driven independently of the ring gear, by a single motor mounted on the end of the shaft as indicated by the dotted lines 15. This system of individual motors does not need any extra mechanical drive and its accuracy is independent of the production speed but in comparison with the clutching system, this method is relatively expensive, due to the need for individual motors and controls.

Figure 4:
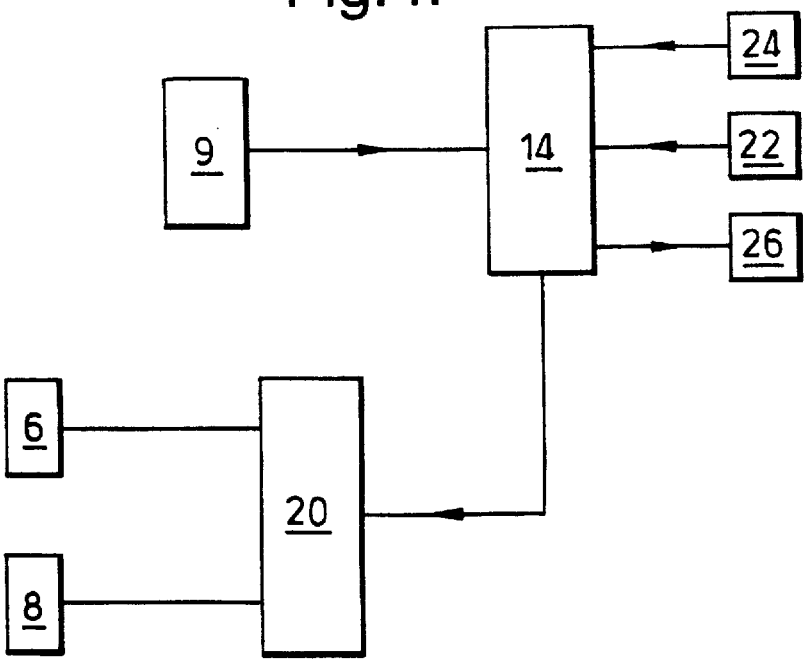
FIG. 4 is a schematic of orientation control.

FIG. 4 shows a block diagram of the orientation control, using a clutching system. In this system, the transfer from the chuck to the mandrel for orientaton is achieved by the switching on and off of air lines 11 and 12 which supply the mandrel and chuck respectively.

A switching mechanism 20 acts as both a compressed air and a vacuum generator, as required for the can retention or release. Thus whilst the required position of the can body is being evaluated, the can body is retained on the chuck by a vacuum switched to line 12 and may be further encouraged by the application of compressed air to line 11. Once the transfer time and the required orientation have been determined, the can body is transferred from the chuck to the mandrel by switching line 12 to compressed air and line 11 to vacuum. These lines may be switched independently if desired. A small clearance of typically 0.1 mm is provided between the chuck and the mandrel to enable the can to be transferred from one to the other.

The switch 20 comprises a manifold which receives a single air supply 16 from a fixed part of the frame via bearings rotating on the shaft. The switch 20 then switches the air lines for each of the 16 heads around the turret in accordance with control signals from each control system 14.

Control is provided by eight systems 14 positioned around the turret. Space constraints limit the number of control systems to one for two heads. An encoder 22 connected to a fixed shaft ensures that correct orientation is achieved independently of the head position around the turret, positional data being received by each control system 14 from two sensors 9 relating to the heads which that system controls.

Each control system thus receives data from a pair of sensors 9, relating to the position of their respective can bodies, as well as encoder data 22 and power 24. This is then used to provide the appropriate actuation of the pneumatic switches 20 and user information 26 for quality control, set up etc. Where a single motor for each chuck is used, the actuation signals will again be provided by control system 14.

Figure 5:
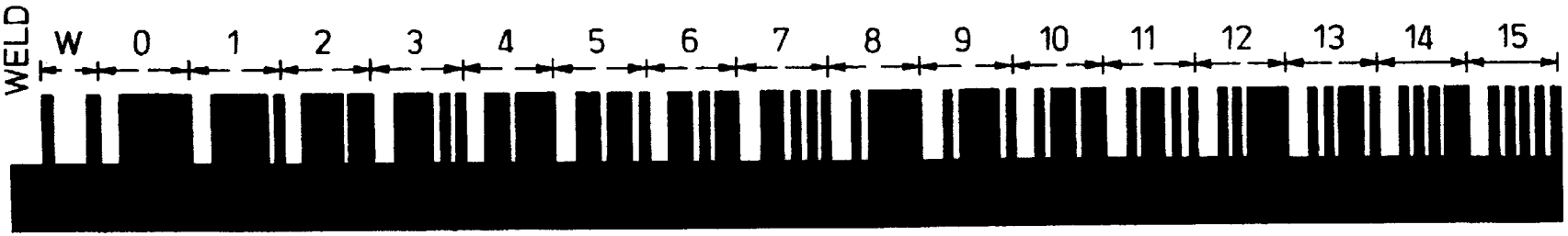
FIG. 5 is a unique mark comprising a series of coded sectors.

In another embodiment a can body is formed from a metal sheet which has first been printed and onto which code sectors, as shown in FIG. 5, have simultaneously been printed. The sheet is cut into strips which are welded into can bodies in known fashion, typically with the coded sectors within 3.2 mm from one free edge of the flanged body on the lower can side wall.

FIG. 5 shows typical series of code sectors for printing around the upper and lower edge of a can body, generally in a position which would be covered by a double seam, once the end is seamed onto the body. This set of code sectors comprises 16 code sectors but it will be appreciated that this number can be varied according to the can circumference, sensitivity of the measuring equipment, the data required in order to analyze the position etc. However, it is usual that the sensor will need to see at least two sectors (two code sectors or a code and a weld sector) so as to see at least one whole sector in its field of vision, although this is not a particular issue when continuous monitoring by individual sensors is used.

At the left hand end of the drawing there is an unprinted weld sector, which in use will contain a weld in a three piece container. This weld sector also includes a white marker, with two black bars either side of this which signifies the presence of a weld to the left of the marker, so that the sensor does not take a false reading at this point.

Each of the sixteen code sectors follows the format of a white "start" sector marker and a binary code made up of white/black marks to signify 0 or 1 in the binary code. There are three marks making up this binary code, so that the code can be from 000 (decimal 0) to 111 (decimal 15) according to the sector number, thus having a code for each sector. If additional sectors are required, then more marks will also be needed.

The whole strip of code sectors shown in FIG. 5 is the length of the can outside circumference, so that the whole can upper edge is marked. This ensures that the sensor will always see at least part of the code.

The binary code in the example of a three piece 73×115 mm food can is position within 4.6 mm from a free edge of the can blank, which is then 3.2 mm from the edge of the flanged body, and is then covered during the seaming operation by the seam which extends 3 mm from the top or bottom of the finished can.

Figure 6:
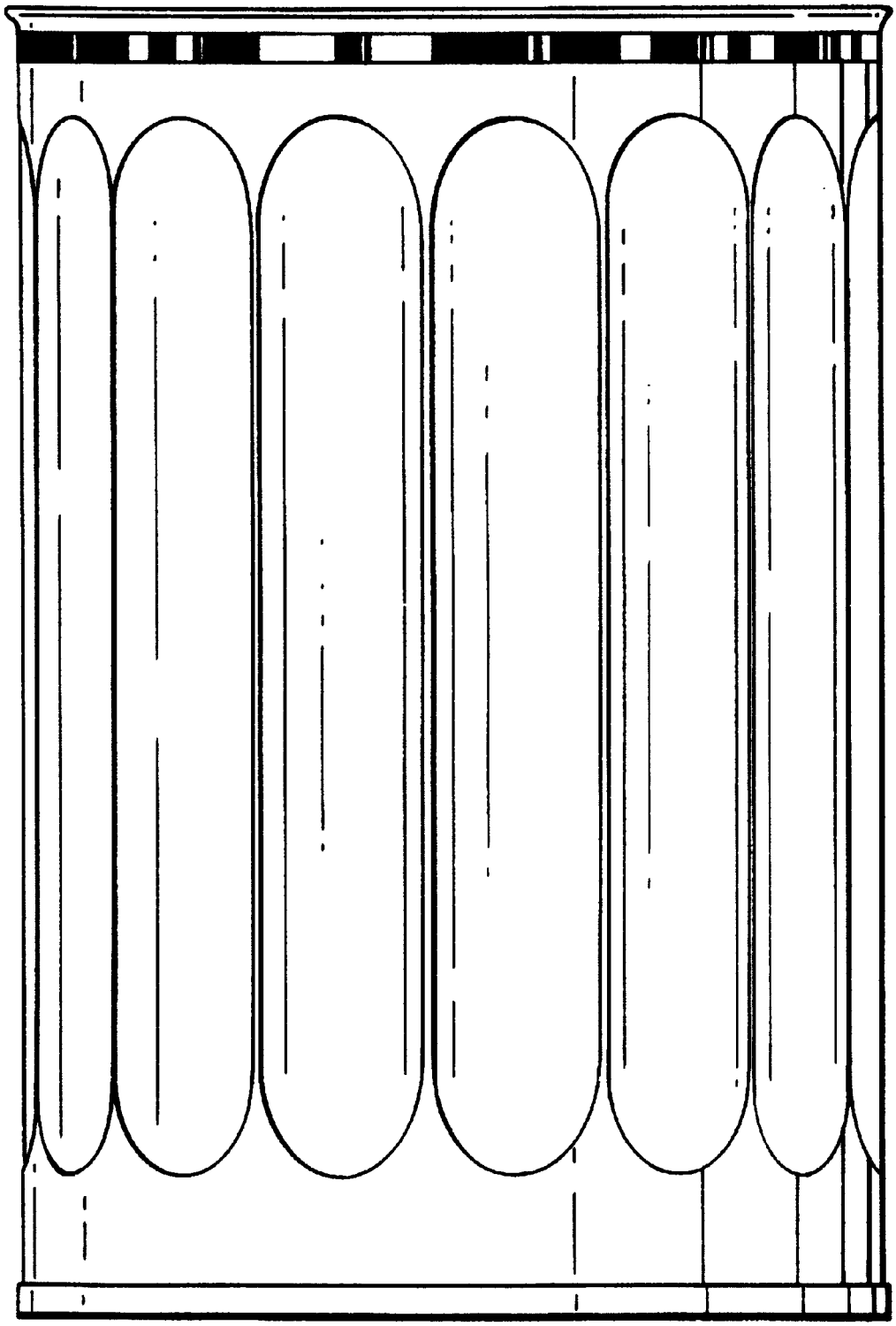
FIG. 6 is a formed can body with coded sectors.

The codes shown in FIG. 5 are particularly adapted for use with a three piece welded can. Clearly a two piece can would not require a weld sector, there being no weld. A typical food can including a code sector, prior to the seaming operation is shown in FIG. 6.

Other embodiments are envisaged within the scope of the present invention, including two piece cans made by drawing and wall-ironing, draw-redraw operations or impact extrusion processes.

It will be appreciated that the invention has been described by way of example only and that changes may be made without departing from the scope of the invention as defined by the claims.

We claim:

1. A method of orienting cans on a continuously rotating machine, the method comprising:

providing a unique mark on each of a plurality of can bodies (2);

feeding the can bodies (2) to the continuously rotating machine;

engaging each can body (2) on a respective chuck (8);

rotating the can body (2) at a first speed;

moving the (an body (2) axially over a mandrel (6) rotating at a second speed, the second speed being different from the first speed;

providing sensor (9) for each can body position on the machine;

sensing the position of each can body (2) by detecting its unique mark;

evaluating the required position of each can body (2);

comparing the sensed position of each can body (2) with the required position; and correcting the orientation of each can body by calculating a transfer time from the difference between the first and second speeds and the required orientation; and, after the transfer time, transferring the can body (2) from the chuck (8) rotating at the first speed onto the mandrel (6) rotating at the second, different speed, whereby the can body (2) is correctly oriented.

2. A method according to claim 1, further comprising continuously sensing the position of each can body by detecting and counting a series of identical marks (10).

3. A method according to claim 2, in which the transferring step comprises switching a vacuum from the chuck to the mandrel, whereby the can body is released from the chuck and pulled onto the mandrel.

4. A method according to claim 2, in which the sensor (9) is fixed to a turret (5) or to a can carrier (7).

5. A method according to claim 1, in which the transferring step comprises switching a vacuum from the chuck to the mandrel, whereby the can body is released from the chuck and pulled onto the mandrel.

6. A method according to claim 5, in which the sensor (9) is fixed to a turret (5) or to a can carrier (7).

7. A method according to claim 1, in which the sensor (9) is fixed to a turret (5) or to a can carrier (7).

8. A method of orienting cans on a continuously rotating machine, the method comprising:

providing a unique mark on each of a plurality of can bodies (2);

feeding the can bodies (2) to the continuously rotating machine;

engaging each can body (2) on a respective chuck (8);

rotating the can body (2) at a first speed;

moving the can body (2) axially over a mandrel (6) rotating at a second speed, the second speed being initially the same as the first speed;

providing a sensor (9) for each can body position on the machine;

sensing the position of each can body (2) by detecting its unique mark;

evaluating the required position of each can body (2);

comparing the sensed position of each can body (2) with the required position; and correcting the orientation of each can body (2) by calculating and imposing variations in the speed of the chuck (8) and/or mandrel (6) to provide the required orientation.

9. A method according to claim 8, in which the sensor (9) is fixed to a turret (5) or to a can carrier (7).

10. An apparatus for roll-forming cans, the apparatus comprising:

a frame;

a turret (5) driven to rotate about an axle fixed to the frame; and a plurality of mandrels (6) mounted around the turret (5) for rotation on axles fixed to the turret (5);

characterized in that the apparatus is for roll-forming cans with registered decoration, and the apparatus further comprises:

a plurality of chucks (8) for driving can bodies (2) mounted on the mandrels (6);

means (9) for sensing the position of each can body by detecting its unique mark;

means (14) for evaluating the required position of each can body (2);

means (14) for comparing the sensed position of each can body (2) with the required position;

means (14) for correcting the orientation of each can body (2) by calculating a transfer time from the difference between the first and second speeds and the required orientation; and means (11,12,20) for transferring the can body from the chuck (8) rotating at the first speed onto the mandrel (6) rotating at the second, different speed, after the transfer time, whereby the can body (2) is correctly oriented.

11. An apparatus for roll-forming cans, the apparatus comprising:

a frame;

a turret (5) driven to rotate about an axle fixed to the frame; and a plurality of mandrels (6) mounted around the turret (5) for rotation on axles fixed to the turret (5);

characterized in that the apparatus is for roll-forming cans with registered decoration, and the apparatus further comprises:

a plurality of chucks (8) for driving can bodies (2) mounted on the mandrels (6);

means (9) for sensing the position of each can body by detecting its unique mark;

means (14) for evaluating the required position of each can body (2);

means (14) for comparing the sensed position of each can body (2) with the required position;

means (14) for correcting the orientation of each can body (2) by calculating and imposing variations in the speed of the chuck (8) and/or mandrel (6) to provide the required orientation.

* * * * *